US006360942B2

(12) United States Patent
Todjar Hengami

(10) Patent No.: US 6,360,942 B2
(45) Date of Patent: Mar. 26, 2002

(54) MULTIPLE COMPARTMENT PACKAGE DESIGN

(76) Inventor: David Todjar Hengami, 4455 Torrance Blvd., #356, Torrance, CA (US) 90503

( * ) Notice: Subject to any disclaimer, the term of this patent is extended or adjusted under 35 U.S.C. 154(b) by 0 days.

(21) Appl. No.: 09/748,696

(22) Filed: Dec. 26, 2000

Related U.S. Application Data

(63) Continuation-in-part of application No. 09/619,700, filed on Jul. 19, 2000.

(60) Provisional application No. 60/172,069, filed on Dec. 23, 1999.

(51) Int. Cl.[7] ..... B65D 5/488; B65D 5/56; B65D 43/12

(52) U.S. Cl. ..... 229/129.1; 229/117.3; 229/117.35; 229/120.03; 229/120.18

(58) Field of Search ..... 229/117.27, 117.28, 229/117.3, 117.31, 117.35, 120.03, 120.18, 121, 122, 125.12, 129.1, 131.1, 164.2, 242

(56) References Cited

U.S. PATENT DOCUMENTS

| | | | | |
|---|---|---|---|---|
| 958,707 A | | 5/1910 | Stafford | |
| 2,387,640 A | | 10/1945 | Bouchelle | |
| 2,569,018 A | * | 9/1951 | Priester | 229/120.18 |
| 2,983,421 A | * | 5/1961 | Turpin | 229/121 |
| 2,983,424 A | | 5/1961 | Glass | |
| 3,031,070 A | | 4/1962 | Mulder | |
| 3,040,953 A | | 6/1962 | Tindall | |
| 3,343,744 A | | 9/1967 | Morell et al. | |
| 4,066,207 A | | 1/1978 | Jorgensen-Beck et al. | |
| 4,081,128 A | * | 3/1978 | O'Neill | 206/536 |
| 4,138,016 A | | 2/1979 | Roccaforte | |
| 4,141,485 A | | 2/1979 | Lambert | |
| 4,269,347 A | | 5/1981 | Cavan, Jr. | |
| 4,342,417 A | | 8/1982 | Forbes, Jr. | |
| 4,361,270 A | * | 11/1982 | Roccaforte | 229/120.03 |
| 4,413,769 A | | 11/1983 | Michetti | |
| 4,609,142 A | | 9/1986 | Adamek | |
| 5,056,708 A | | 10/1991 | Boyle et al. | |
| 5,263,612 A | | 11/1993 | Nederveld | |
| 5,348,219 A | | 9/1994 | Brintazzoli | |
| 5,413,276 A | | 5/1995 | Sheffer | |
| 5,429,243 A | | 7/1995 | Woelk et al. | |
| 5,505,373 A | | 4/1996 | von Stillfried | |
| 6,089,369 A | | 7/2000 | Markey | |

OTHER PUBLICATIONS

International Search Report for International Application PCT/US00/35330 dated May 2, 2001.

* cited by examiner

*Primary Examiner*—Gary E. Elkins
(74) *Attorney, Agent, or Firm*—Oppenheimer Wolff & Donnelly LLP

(57) ABSTRACT

A box for conveniently storing and dispensing pourable materials has a front wail having a first and a second opening and an inside surface. The box also has a back wall, a first and a second side wall, a bottom flap and a first and a second top flap. A first slide and a second slide are in contact with the inside surface of the front wall, each of said slides having an opening. The front wall, the back wall, the first and second side walls, and the top and bottom flaps are interconnected so as to form a box. The first slide is movable between an open position in which it substantially aligns with the first front wall opening, and a closed position in which it is entirely out of alignment with the first front wall opening. The second slide moves independently from the first slide. The second slide is movable between an open position in which the second slide opening substantially aligns with the second front wall opening, and a closed position in which the second slide opening is entirely out of alignment with the second front wall opening. Additional slides can be added, as desired. The box may include separate interior compartments in which, for example, different products may be stored.

18 Claims, 13 Drawing Sheets

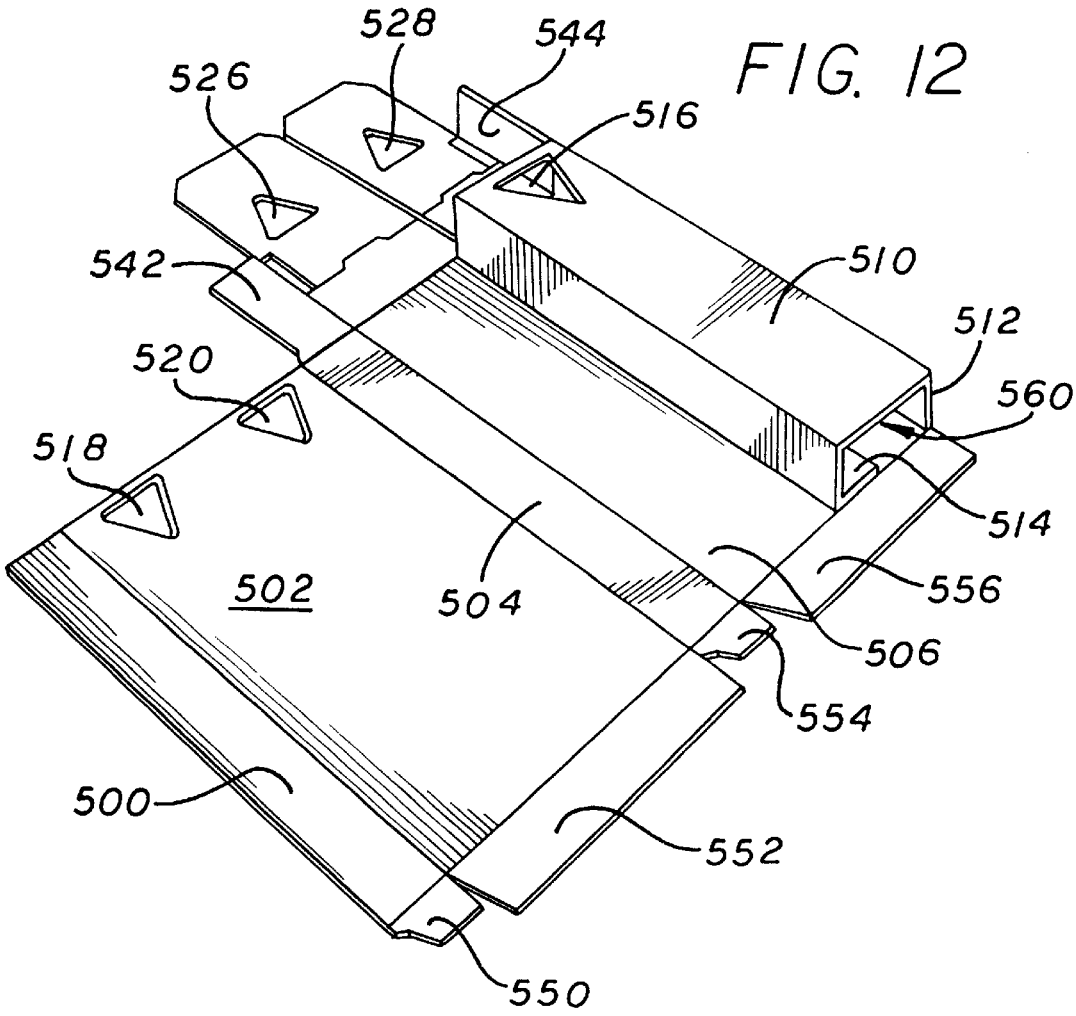
FIG. 12
FIG. 14
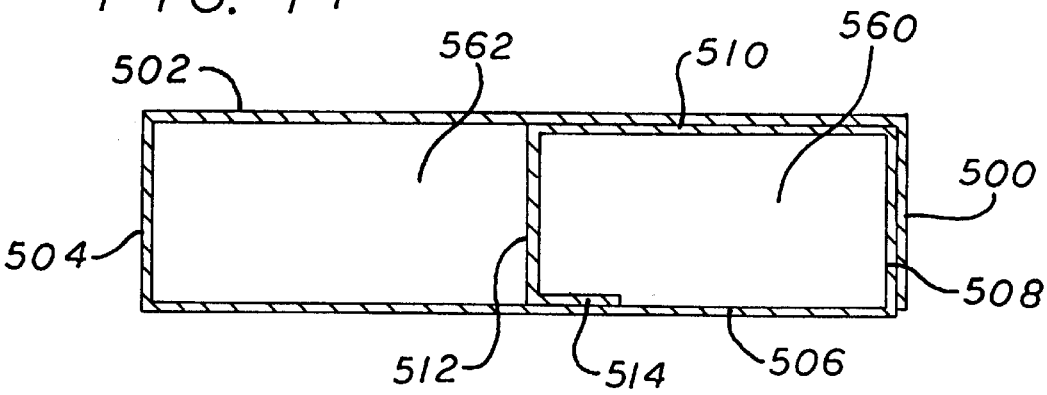

MULTIPLE COMPARTMENT PACKAGE DESIGN

I. RELATED PATENTS

This patent application relates to U.S. Pat. No. 5,505,373, which is entitled Folding Package and which issued on Apr. 9, 1996, and to U.S. Pat. No. 6,116,499, which is entitled Package Design and which issued on Sep. 12, 2000, both of which are hereby incorporated by reference. This patent application is a continuation-in-part of U.S. patent application Ser. No. 09/619,700 by David Todjar Hengami, entitled IMPROVED PACKAGE DESIGNS, which was filed on Jul. 19, 2000 and which is hereby incorporated by reference. This application claims priority from U.S. Provisional Patent Application No. 60/1172,069 by David Todjar Hengami, which was filed on Dec. 23, 1999 and which is hereby incorporated by reference.

II. BACKGROUND OF THE INVENTION

A. Field of the Invention

The present invention relates to the field of packaging and, in particular, to packaging for pourable food and other items.

B. Prior Art

A wide range of pourable products, such as candies, cereals, laundry soaps, and many other products, are dispensed in cardboard boxes. To access the contents, a user must generally open the top of the box. Sometimes the contents are held in a wax paper bag inside the box, and the bag must be opened as well. To store the contents, the user closes the bag and then closes the box.

U.S. Pat. No. 6,505,373 discloses a novel box for conveniently storing and dispensing pourable items. The box has a back wall and a slide connected to the back wall. The slide has a slide opening and two side tabs extending from the slide. A front wall with an opening is connected to the back wall. The box also has an interior supporting wall having first and second side slits. The slide is disposed within the box, with each of the tabs being inserted into a corresponding one of the slits. The box has an open position in which the openings are aligned and in which the contents of the box may be poured out. The box also has a closed position for storing the contents.

III. SUMMARY OF INVENTION

In one embodiment of the present invention, a box for conveniently storing and dispensing pourable materials has a front wall having a first and a second opening and an inside surface. The box also has a back wall, a first and a second side wall, a bottom flap and a first and a second top flap. A first slide and a second slide are in contact with the inside surface of the front wall, each of said slides having an opening. The front wall, the back wall, the first and second side walls, and the top and bottom flaps are interconnected so as to form a box. The first slide is movable between an open position in which it substantially aligns with the first front wall opening, and a closed position in which it is entirely out of alignment with the first front wall opening. The second slide moves independently from the first slide. The second slide is movable between an open position in which the second slide opening substantially aligns with the second front wall opening, and a closed position in which the second slide opening is entirely out of alignment with the second front wall opening.

In particular embodiments, the box may have a supporting wall disposed adjacent to at least a portion of the inside surface of the front wall. The supporting wall may have an opening that is aligned with one of the front wall openings. At least one of the slides may be disposed in between the front wall and the supporting wall.

The box may also have a first compartment and a second compartment. The first compartment may be opened when the first slide is in the open position. The second compartment may be opened when the second slide is in the open position. An interior wall may separate the first compartment from the second compartment. The box may further comprise a front compartment wall that is disposed adjacent to a portion of the inside surface of the front wall, the front compartment wall having an opening that is aligned with one of the front wall openings. The front compartment wall may extend across the width of one of the compartments.

The box may have a top opening. A top inner flap may extend across the top opening. The top inner flap may consist of a single flap member, or may be formed from two or more members. The two or more members may be secured together to form a single top inner flap.

The box may have a stop for defining the position of at least one of said slides in the open position of said at least one slide. The box may have a first stop for defining the position of the first slide in the open position of the first slide. The box may also have a second stop for defining the position of the second slide in the open position of the second slide.

The openings in the slides may be substantially the same shape as the openings in the front wall. Alternatively, the slide openings may be one shape and the openings in the front wall another shape, if desired. The top flaps are connected to the back wall in an articulated manner, such that the user may lift the top flaps to slide the slides between the open and closed positions.

Embodiments of boxes according to the present invention may incorporate an inner liner. In one embodiment, an inner liner resides within the box. The inner liner may include a removable portion that is adjacent to a front wall opening in the box. To initially access the contents of the inner liner, the user moves the slide into the open position. The user then removes the removable portion of the inner liner, and may then pour contents of the inner liner out of the box.

In a multiple-compartment box, there may be more than one inner liner. For example, one inner liner may be a bag in one compartment, while another inner liner may be a separate bag in another compartment of the box. As a further alternative, the box itself may not have multiple compartments but, instead, a plurality of different bags inside of the box may serve to separate different products that are stored within the same box.

Other objects and features of the invention will become apparent from a review of the Detailed Description below, from the drawings, and from the claims.

IV. BRIEF DESCRIPTION OF THE DRAWINGS

FIG. 12 illustrates the box blank of FIG. 11 partially folded and secured to form one compartment;

FIG. 14 is a cross-section taken across section 14—14 of FIG. 13, illustrating the two interior compartments;

Figure 17:
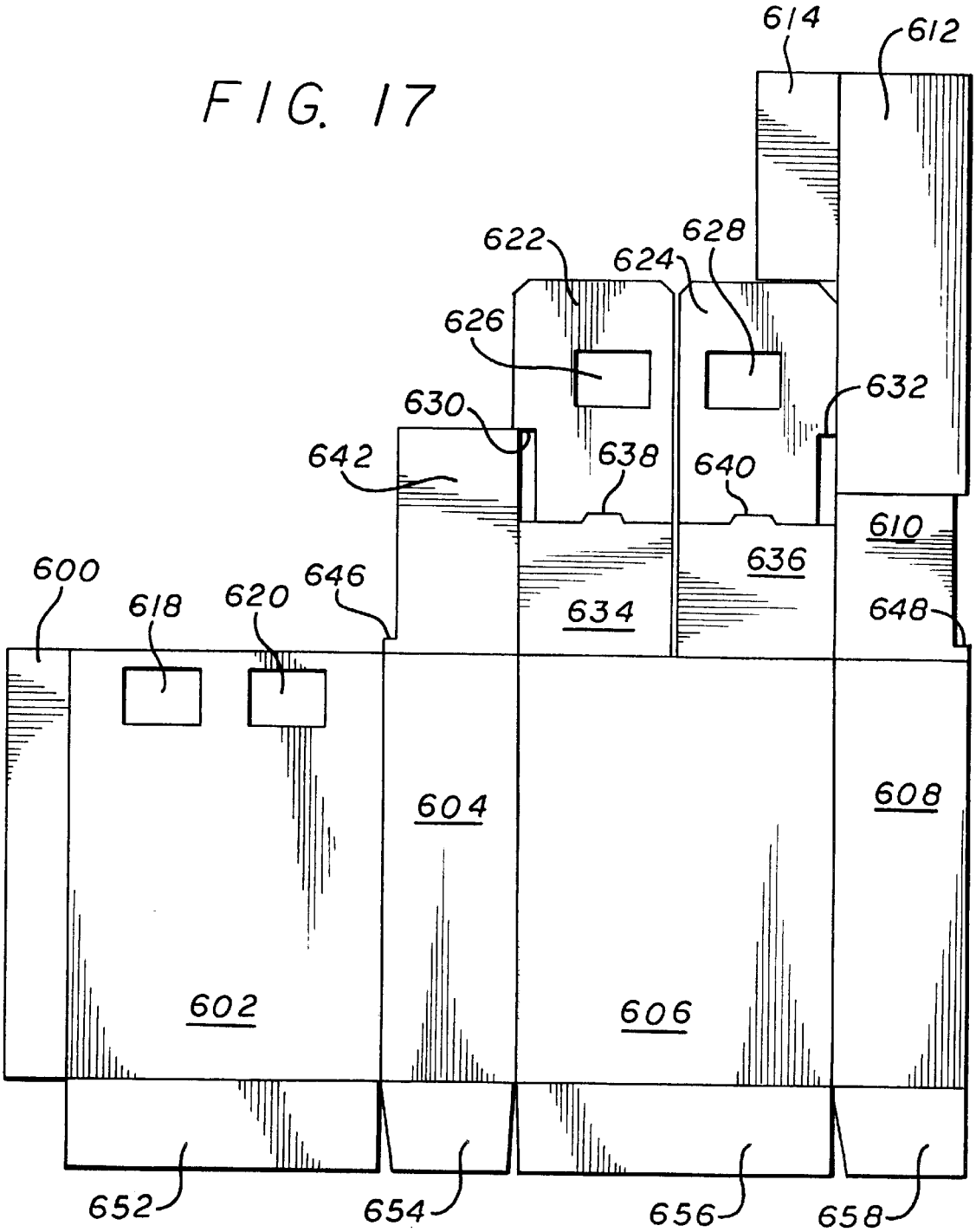
FIG. 17 illustrates a box blank that can be folded and secured to form an alternative multiple compartment box.
Figure 18:
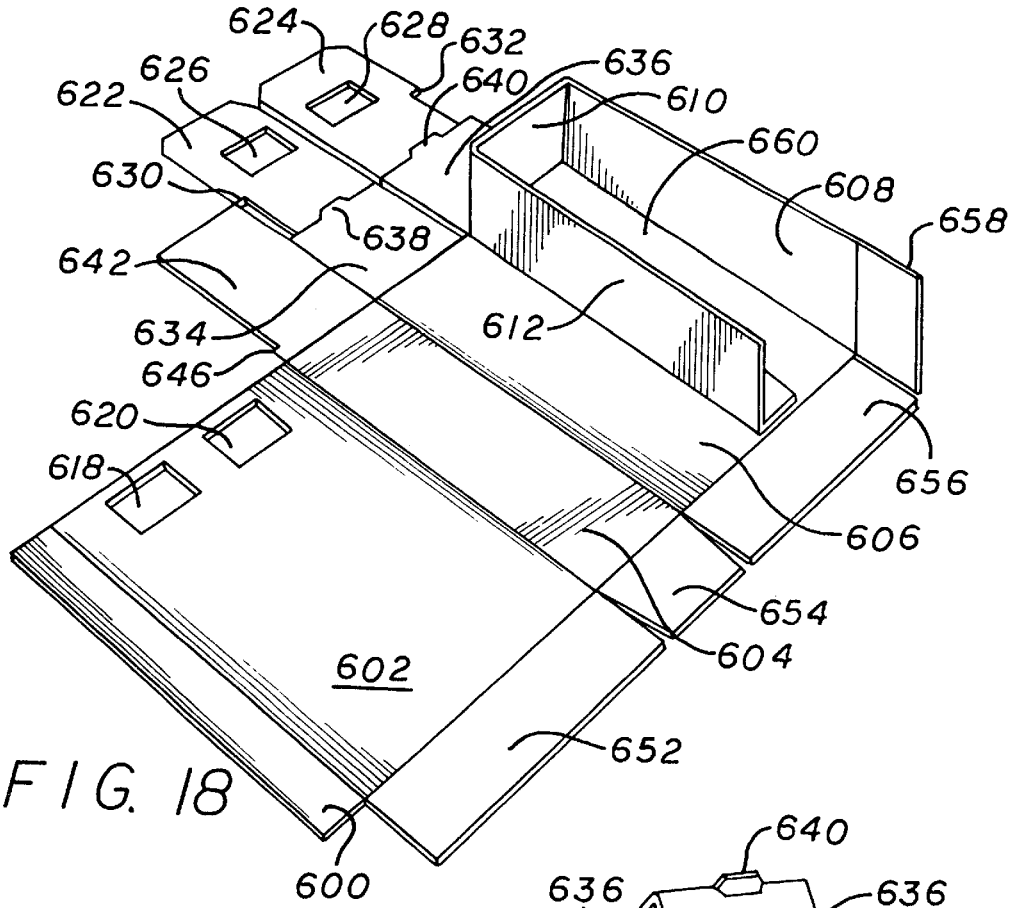
Figure 19:
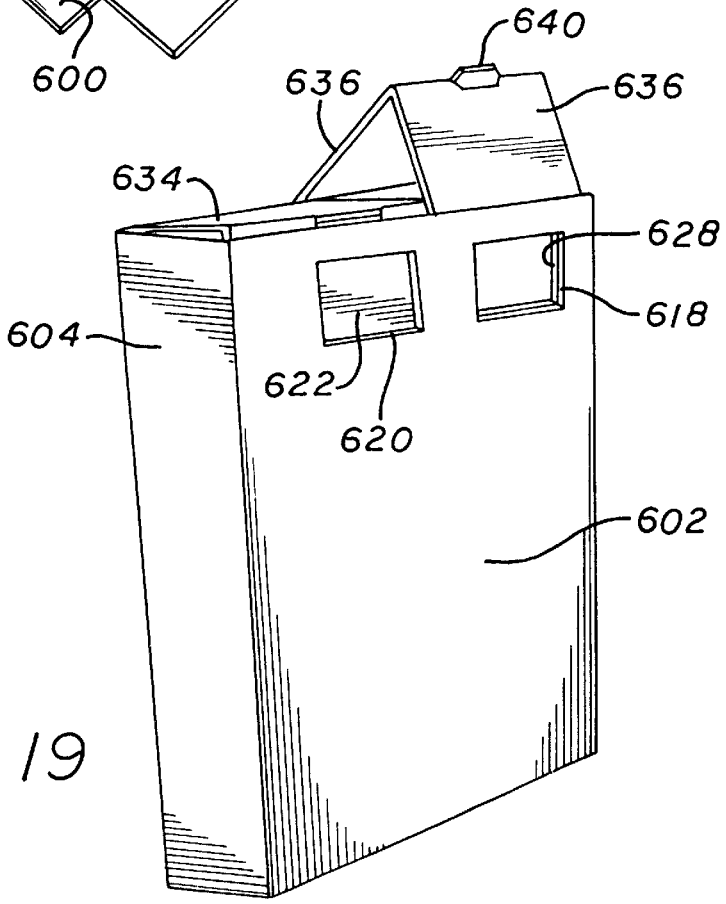

FIG. 18. Illustrates the box blank of FIG. 13 partially folded and secured to form one compartment; and FIG. 19 illustrates a box formed from the box blank of FIG. 17, with one slide in an open position.

V. DETAILED DESCRIPTION OF THE PREFERRED EMBODIMENT

Figure 1:
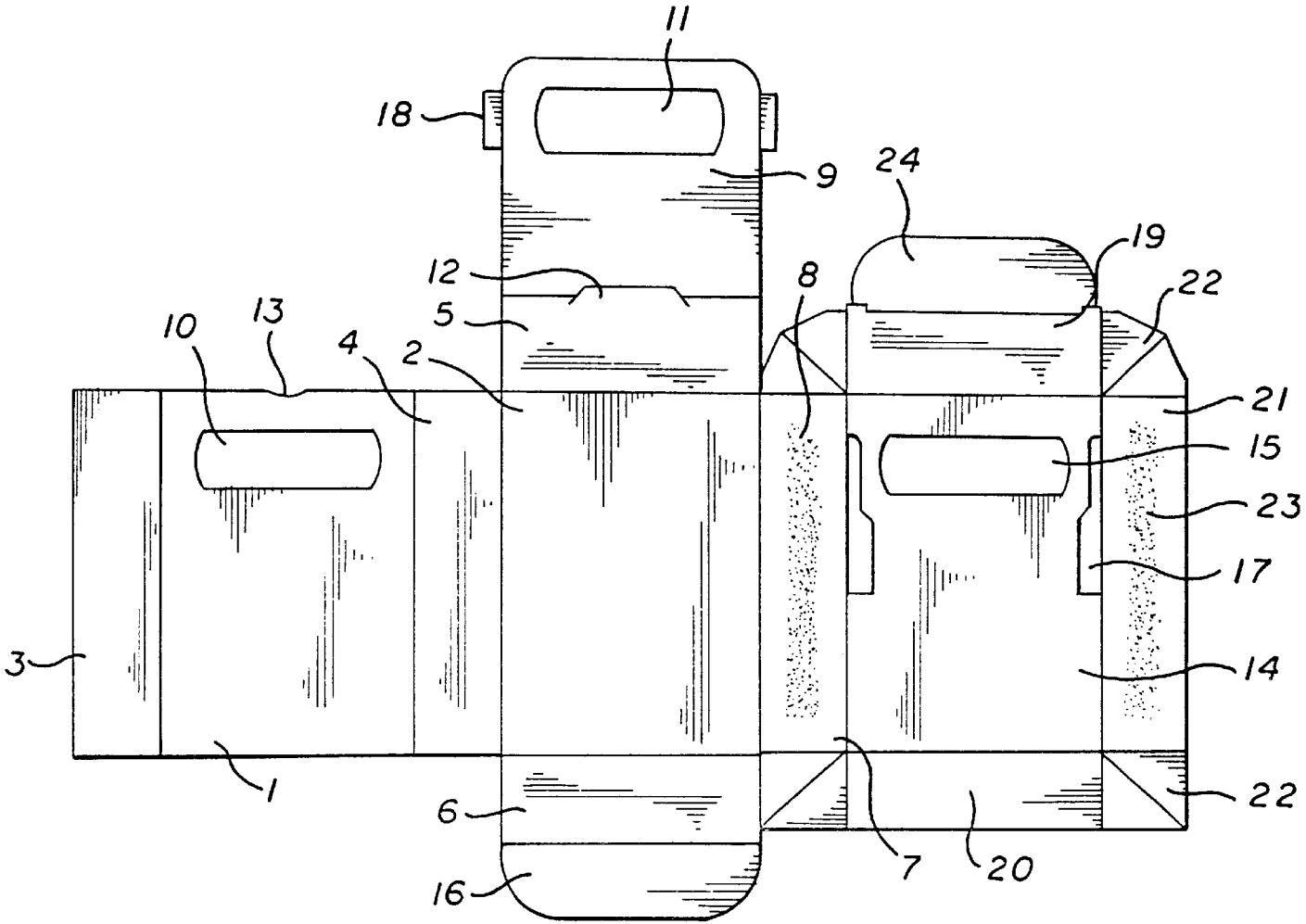
FIG. 1 (PRIOR ART)
FIG. 1 illustrates a blank from which a box according to the present invention is formed.

The box formed from the blank according to FIG. 1 has six outer walls, namely a front wall 1 and a back wall 2, a first side wall 3 and a second side wall 4 and a top flap 5 and a bottom flap 6. Between two of these walls the cross-section has folding lines F that define the edges of the finished box. A partition 7 is connected to the back wall 2 by a folding line. Partition 7 has a coating 8 of adhesive to bond the partition to the inside surface of the first side wall 3.

A bottom tongue 16 is connected to the bottom flap and its outside surface is in contact with the inside surface of front wall I when the box is completely assembled. A slide 9 is connected to the top flap 5 by a folding line and its outside surface is also in contact with the inside surface of front wall 1 when the box is fully assembled.

Front wall 1 has an opening 10. A corresponding slide opening 11 with a matching shape is provided in slide 9. When the top flap 5 is raised by thumb flap 12, slide 9 is raised along the inside surface of front wall 1 so the slide opening 11 comes to cover the opening 10 in front wall 1. Now the pourable product can be poured or shaken out of the box through the corresponding openings in the front wall 1 and slide 9. When pressure is applied from above to push the top flap 5 of the slide 9 down behind the front wall 1, the unperforated section of slide 9 closes off the opening 10 in the front wall. A recess 13 that facilitates the engagement of thumb flap 12 is provided in the front wall 1 in order to make it easier to open the box.

A supporting wall 14 is connected to the partition 7. When the box has been fully assembled, the supporting wall is on the inside next to the front wall 1. It has essentially the same dimensions as the front wall 1, and specifically it has an opening 15 which corresponds to the opening 10 in the front wall when the box is fully assembled.

The slide 9 is between the front wall 1 and the supporting wall 14 when the box is assembled, as is the lower tongue 16 that is connected to the bottom flap 6. The supporting wall 14 has two slits 17. The two straps 18 that project at a right angle from the slide in the direction of the interior of the box after the box has been assembled engage into these two slits. This forms a stop that defines the position of the slide 9 with regard to the supporting wall 14 and the front wall I when the box is open and prevents the slide from pulling out of the space between front wall 1 and supporting wall 14.

A top inner wall 19, a bottom inner wall 20 and a side inner wall 21 are attached to the side wall 14. There are four corner flaps 22, each arranged in a corner between the inner walls and the partition. The comer flaps are attached to the neighboring walls by fold lines, and another fold line divides each comer flap into two parts, so the corner flaps are folded into the inside of the box when the box is assembled.

The inner side wall 21 has an adhesive coating 23 for bonding it to the inside surface of the second side wall 4.

When the box is assembled, the bottom inner wall 20 is beneath the bottom flap 6 and the top inner wall 19 is beneath the top flap 5. The top tongue 24 that is attached to the top inner wall 19 is in contact with the inner surface of the back wall 2. The top inner wall 19 seals the box at the top, even when the top flap 5 is raised in order to open the box at openings 10, 11 and 15 by lifting the slide.

The blank of FIG. 1 is preferably die cut or laser cut from a sheet of material such as light cardboard or other material suitable for forming a box. The blank may be scored at fold lines to facilitate easily folding the blank into a box. The box is typically secured together with one of the adhesives that is conventional in the art.

Figure 3:
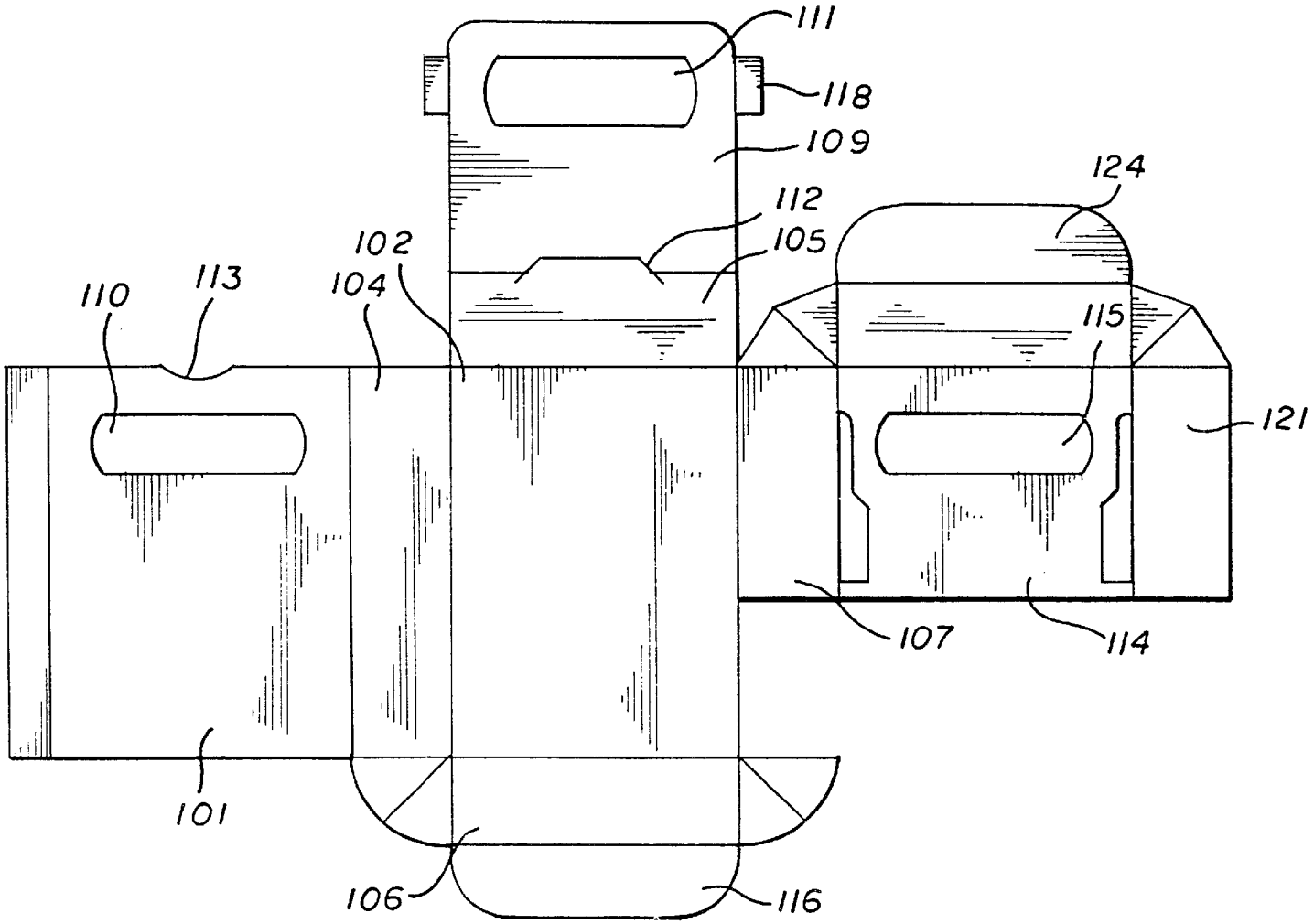
FIG. 3 illustrates a blank from which an alternative embodiment of the present invention is formed.

FIG. 3 illustrates an alternative design that requires somewhat less material to construct. The components of the design are numbered consistently with the components of FIG. 1, with the numbering increased by 100. The supporting wall 114 is somewhat shorter than the supporting wall 14 in FIG. 1. The partition 107 may also be somewhat shorter than the partition 7 in FIG. 1. In the embodiment of FIG. 1, there is a side wall 3 that the embodiment of FIG. 3 does not include, for the purpose of further saving material.

In FIG. 3, the supporting wall 114, the partition 107, and the inner side wall 121 are approximately one-half the length (or other shortened length) of corresponding wall 14, partition 7 and inner side wall 21 in FIG. 1. When hundreds of thousands or millions of the same box are produced, the shortened walls and partition can result in a large savings of material and reduced production costs. Eliminating the side wall 3 of FIG. 1 can further reduce the material and cost requirements.

Figure 4:
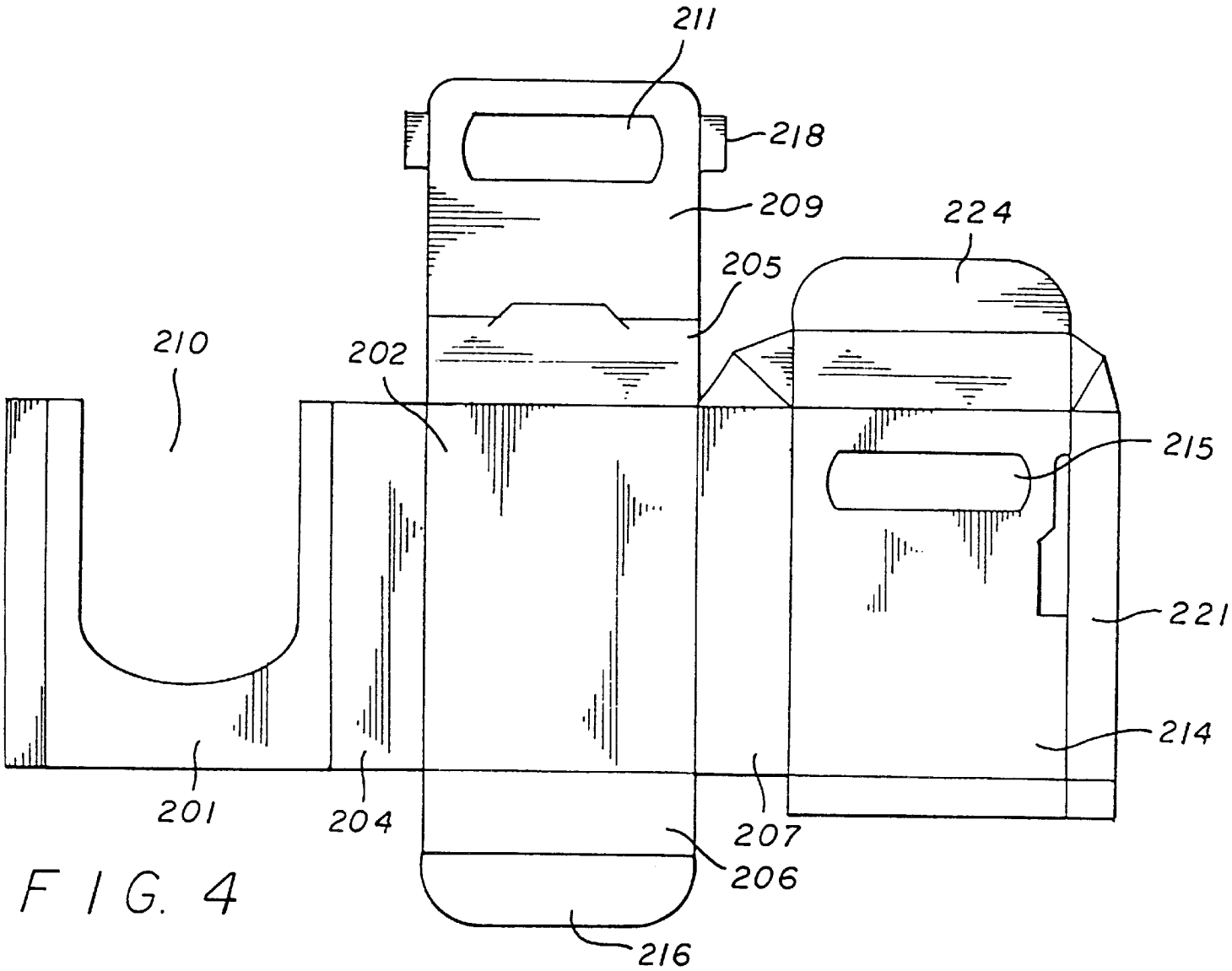
FIG. 4 illustrates a blank from which another alternative embodiment of the present invention is formed.

FIG. 4 illustrates a further alternative design. The components of the design are numbered consistently with the components of FIG. 1, with the numbering increased by 200. In this embodiment, the opening 210 is substantially larger than the corresponding opening 10 in the embodiment of FIG. 1. To further save material, the height of the supporting wall 214, inner side wall 221 and partition 207 can be reduced as in FIG. 3. Alternatively, the inner side 221 and supporting wall 214 can be eliminated entirely. To form the box, the front wall 201 would then be connected to partition 207, which could be provided with an extension to which front wall 201 could be adhered. Bottom tongue 216 could also be eliminated.

Figure 5:
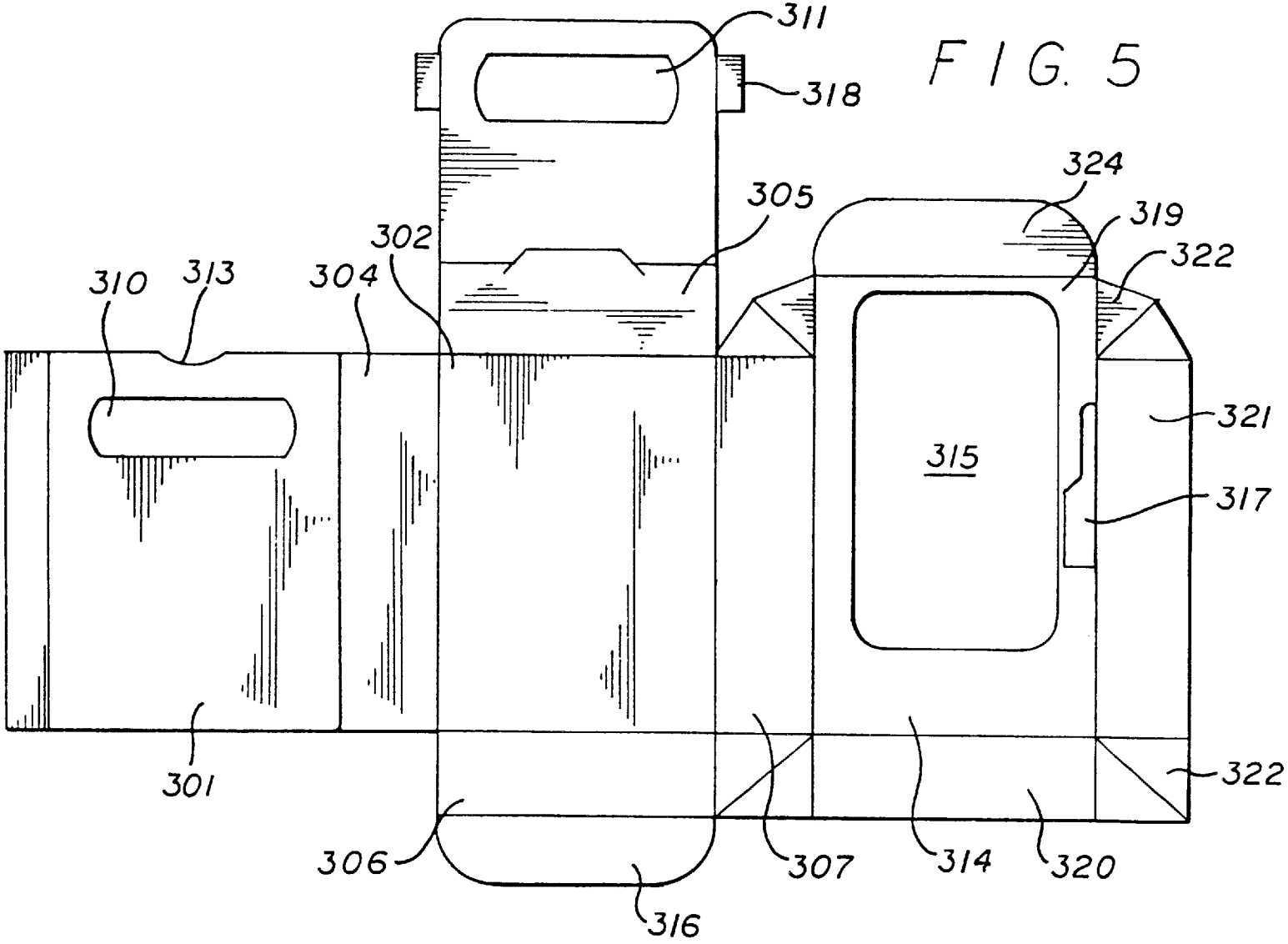
FIG. 5 illustrates a blank from which a further alternative embodiment of the present invention is formed.

FIG. 5 illustrates a further alternative design in which the opening 315 is enlarged in order to save material. The opening 315 extends into the top inner wall 319, and below the midpoint of the supporting wall 314. The first side wall 3 of FIG. 1 is also eliminated. The tabs 318 are optional and, if eliminated, the slits 317 may also be eliminated.

Material may be added or reduced from the box designs depending on the type of pourable product that is to be stored in the box. For example, the box may require more rigidity in order to store heavier items such as rice or some candies. Consequently, the design of FIG. 1 may be preferred over the design of FIG. 4 or FIG. 5 for use with certain products. On the other hand, lighter items, such as popcorn, dried pastas, and many other light weight products, may be stored in a box requiring less material than the design of FIG. 1.

Various embodiments of the present invention may be used in conjunction with a bag that fits inside the box. The general concept of bags within a box is conventional. For example, cereal is generally stored inside a wax paper or cellophane bag that the user opens from the top in order to pour the cereal from the box.

Figure 6:
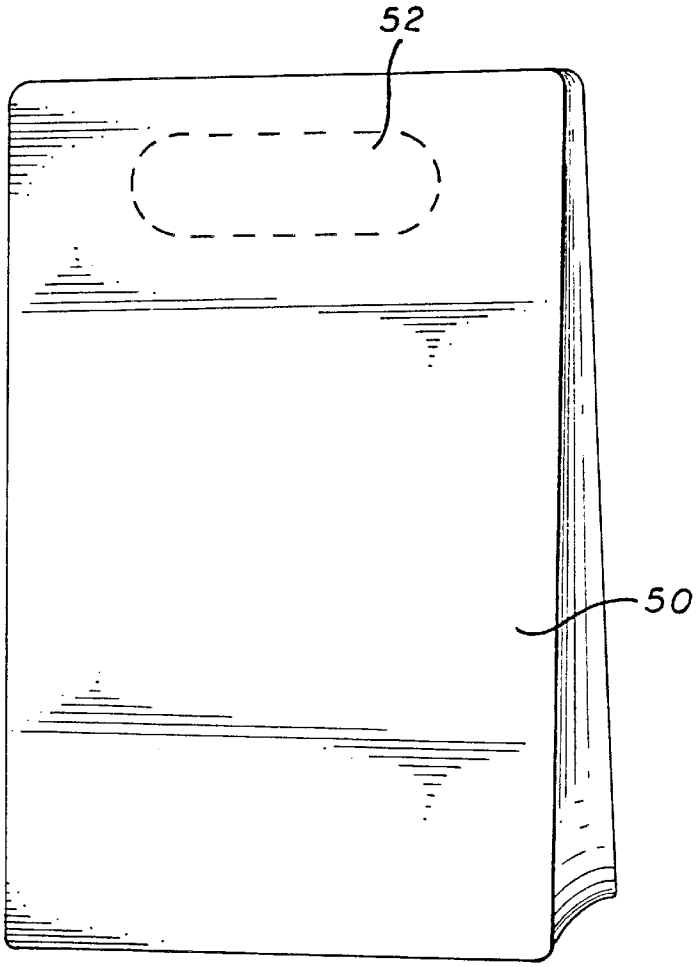
FIG. 6 illustrates one embodiment of an inner liner according to the present invention.
Figure 2:
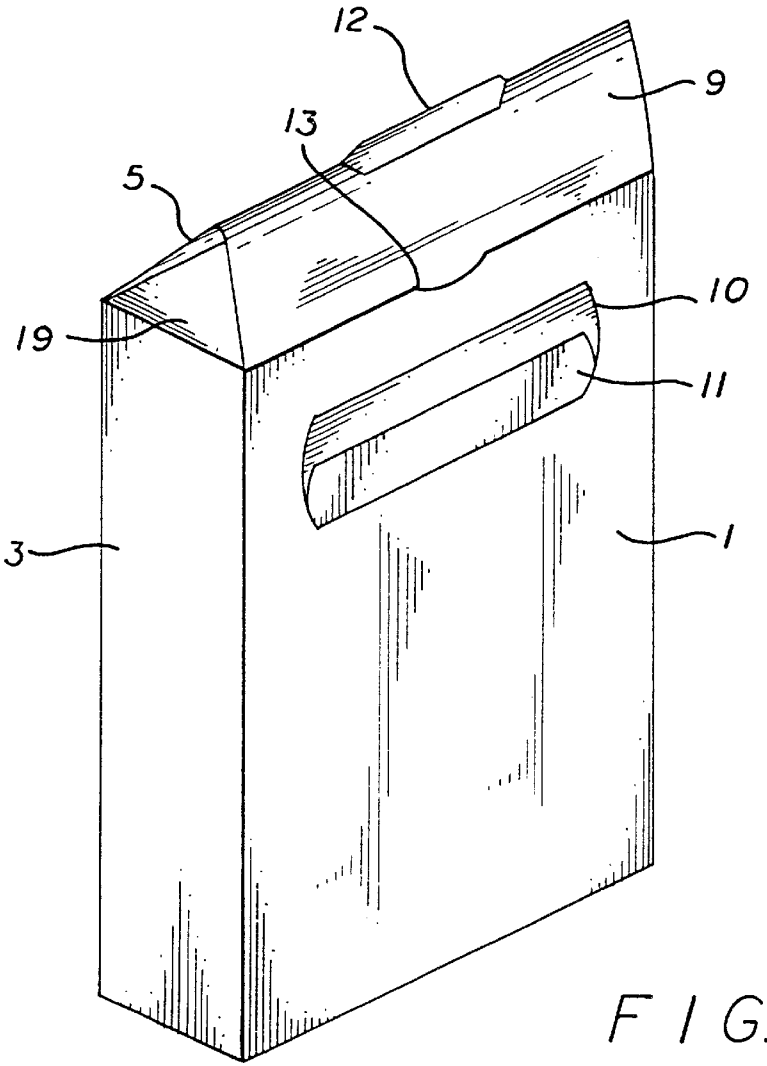
FIG. 2 (PRIOR ART)
FIG. 2 is a perspective view of the box designed from the blank of FIG. 1 in a half-opened state.

FIG. 6 illustrates a bag 50 having a perforated area 52. The perforated area 52 is positioned to correspond with the box opening 10, for example, in FIG. 2. Referring to FIG. 2, to open the bag, the user slides the slide 9 into the open position. The user then opens the bag 50 by reaching through the box opening 10, grasping the perforated area of the bag 52, and removing the area of the bag defined by perforations 54. The bag is then open, and the user can pour contents of the bag 50 through the now-opened portion of the bag, and out of the box through the opening 10.

In the presently preferred embodiment of the bag 50, the perforated area 52 is defined by microperforations, which are fine perforations that leave a relatively smooth edge after separation. However, alternatively, other types of perforations may be used. As an alternative to perforations, other forms of weakening may be employed, such as scoring.

As a further alternative, the bag 50 may be provided with an aperture. A sticker that is backed with a removable adhesive is applied to the bag 50 to seal off the aperture. To open the bag, the user removes the sticker from the aperture, so that the user may pour contents of the bag through the bag aperture and out the box aperture when the box is in the open position. The sticker may have a preprinted design and/or indicia on one or both surfaces. The bag may be provided with a release coating such as silicone to facilitate easy removal of the sticker. Alternatively, the bag may be constructed of a material from which the sticker may be peeled without a release coating. To reseal the bag, the user may replace the sticker on the bag. Alternatively, the user may seal the opening of the box itself with the sticker. As a further alternative, the user need not reseal the box opening or the bag opening at all, as the slide prevents the contents of the bag from pouring out of the box when the slide is in the closed position.

Figure 7:
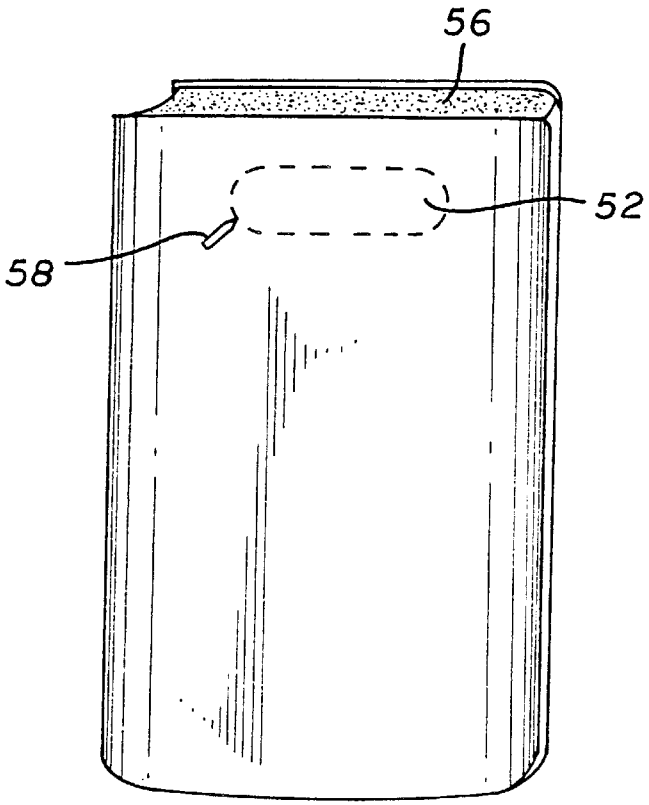
FIG. 7 illustrates an alternative embodiment of the inner liner of FIG. 6.

The bag 50 may be adhered to the interior of the box in order to ensure that the bag opening remains aligned with the box opening 10. In one embodiment, the top of the bag 56 (FIG. 7) is adhered to the top interior of the box. The bag may also be adhered to the side of the box or, in some embodiments, may be adhered to the bottom of the box, or may be otherwise secured within the box so that the bag opening aligns with the box opening in the open position. In one embodiment, the bag is glued to the interior of the box immediately adjacent to the box opening, so that the bag opening is held in alignment with the box opening. The perforated area may be glued to the slide, such that when the slide is lifted, the perforated area is torn open.

The perforated area 52 may optionally be connected to a tab 58 to simplify opening the bag. When the box is open, the user may reach through the box opening 10, grasp the tab 58, and pull the tab in order to remove the area 52 from the bag. The tab 58 may be made of the same material as the bag or, alternatively, may be made of a different material. The tab 58 may be formed integrally with the bag as, for example, by simply die-cutting a tab out the portion 52. However, the tab 58 is preferably a separate member that is attached to the area 52 by conventional means.

Figure 8:
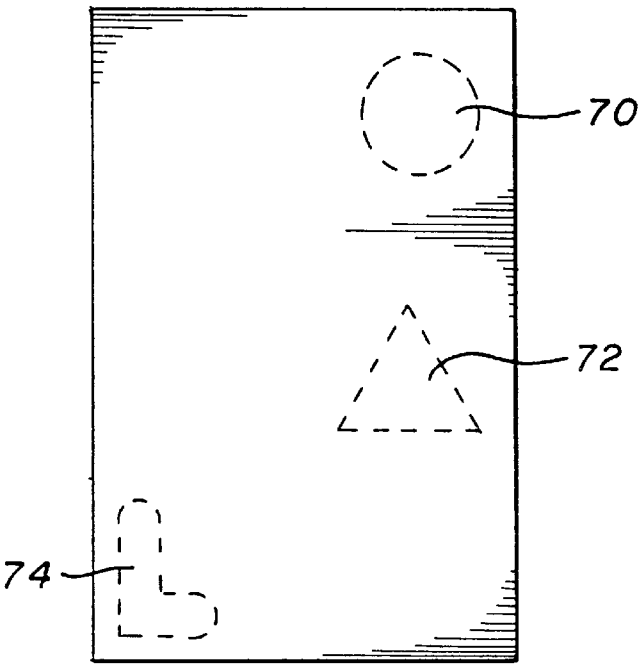
FIG. 8 is a view of one side of a box according to the present invention having more than one front opening.

The foregoing has described a presently preferred embodiment of the invention, as well as alternative embodiments. However, it should be understood that the scope of the invention is not limited to what is described in the Detailed Description. Numerous variations may be employed within the scope of the invention. For example, referring to FIG. 1, the opening 10 may be located at various other positions on the box. Referring to FIG. 8, the opening may be moved to an upper comer, to one side of the center, and/or to a lower corner. Any other position on the front is possible. The slide opening 11 (FIG. 1) should be located on the slide so as to be out of alignment with the box opening when in the closed position, and aligned with the box opening in the open position, so that the user can open and close the box opening by sliding the slide.

Figure 10:
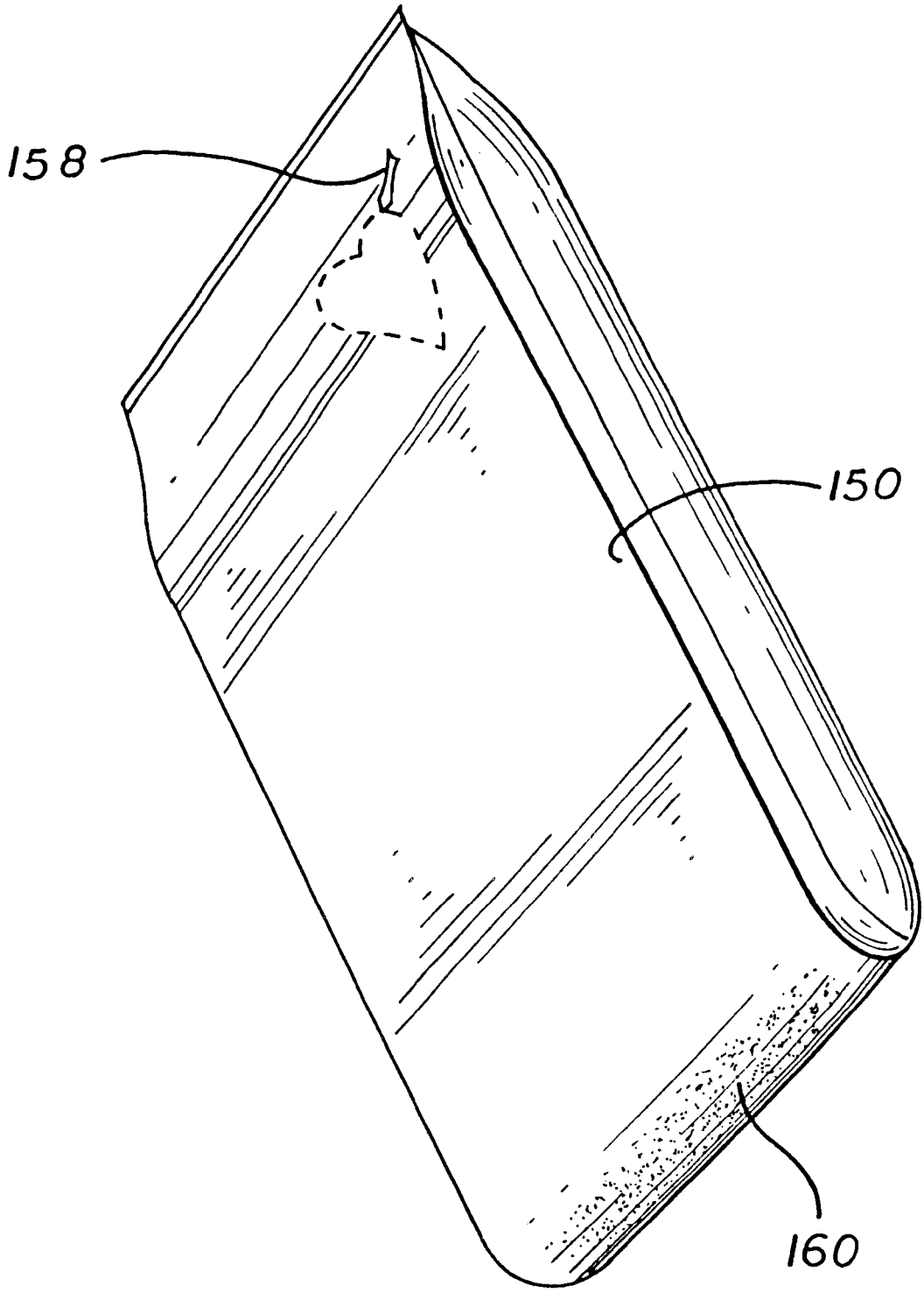
FIG. 10 illustrates a bag that is compatible with the box formed from the blank of FIG. 9, in which the perforated removable portion of the bag is heart-shaped to correspond with the heart-shaped opening of the box.

Referring again to FIG. 8, the opening can have any shape, such as circle 70, triangle 72, or L-shape 74. A wide range of opening shapes and sizes is available. FIG. 10 illustrates that the openings in the box may have a shape to correspond with the shape of the opening in the bag.

The box and the bag may each have more than one opening. The slide may have a plurality of openings, too, so that in the open position, several box openings are opened simultaneously. Alternatively, the openings in the slide may be such that sliding the slide a certain distance opens less than all of the box openings. With further sliding, one or more additional openings may be opened. As a further alternative, the box and bag may be provided with several openings, while the slide is provided with only one opening. The slide opening can then be moved from box opening to box opening, allowing the user to choose from which opening to pour.

Figure 9:
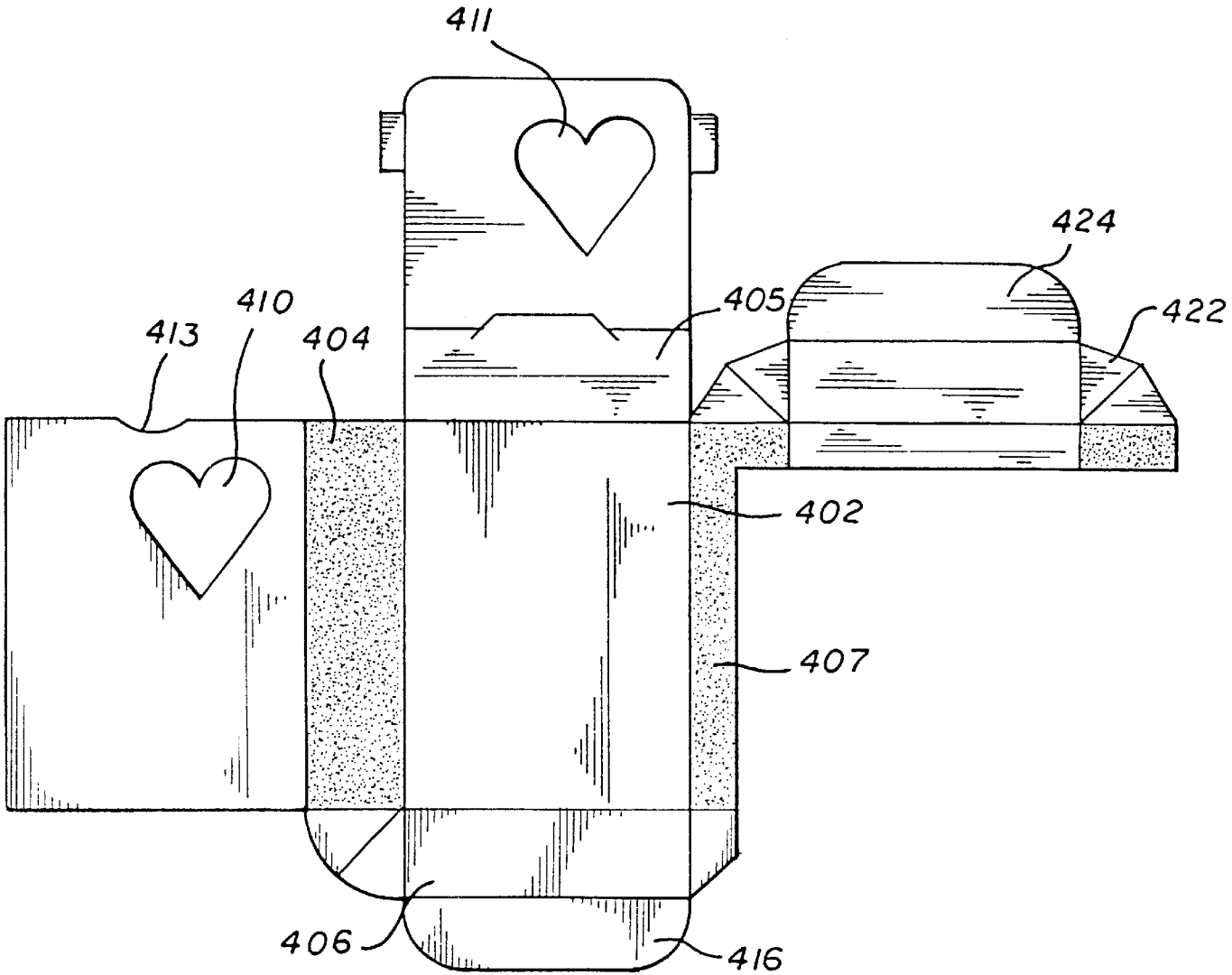
FIG. 9 illustrates a blank from which another alternative embodiment of the present invention is formed, this embodiment having a heart-shaped opening.

FIG. 9 illustrates an alternative embodiment of the present invention in which the various components are, numbered consistently with the numbering of FIG. 1, with 400 added. In FIG. 9 the box openings 410 and 411 are heart-shaped, rather than the elongated, narrow shape of opening 10 in FIG. 3. If an inner bag is used inside the box, the bag may also have a heart-shaped opening.

The box of FIG. 9 has a portion 422 that folds inside of the box. The lower portion of 422 may be glued in place to secure the blank into a box. Relatively little material is required to form the right hand side of the blank illustrated in FIG. 9, and the embodiment of FIG. 9 is particularly material-efficient.

FIG. 10 illustrates one embodiment of a bag 150 that is compatible with the box of FIG. 9. The bag of FIG. 10 has a removable heart-shaped area 152 defined by one or more lines of weakness, preferably perforations. The position of the heart-shaped area 152 corresponds with heart-shaped opening 410 in the box of FIG. 9. The bag 150 may be glued in place at the bottom of the bag 160 or else where the box to align the heart shaped area 152 with box opening 41 0.

The embodiments of the present invention may be formed from a wide variety of materials. The presently-preferred material is sulfate cellulose cardboard. However, the box may alternatively be made of plastic or wax. Other materials such as paper and wood may also be utilized to form part or all of the box in special embodiments, as well as a variety of cardboards. The material may be coated, if desired, with a moisture-resistant coating.

In a further embodiment, the box opening and/or the slide opening may be sealed with a small sheet of plastic, wax paper, or other sealing material. The small sheet may be adhered about the edges of the opening with an adhesive, or otherwise attached to the box. The small sheet may be perforated or provided with lines of weakness to define a removable portion, which the user removes before dispensing the contents of the box. A tab or tear strip may be provided on the sealing sheet to assist in removing the removable portion. Alternatively, the sheet may be a sticker that the user peels away rather than tearing. This embodiment may be used without an inner liner with some pourable products, such as powdered dishwasher soap and rice, to name just a few.

In a further alternative embodiment, a bag is provided with a zipper or other known sliding closure system. In this embodiment, the user slides the closure to an open position rather than tearing along a line of weakness. The bag can then be re-sealed by sliding the closure to a shut position.

It is possible to form boxes having multiple interior compartments. This type of box is particularly useful when two different types of products are to be stored in the same container. For example, it might be desirable to provide a box for storing and dispensing raisins, in which dark raisins are stored in one portion of the box, and golden raisins are stored separately in another portion of the box. Or, powdered laundry detergent may be stored in one portion of the box, while powdered bleach may be stored in another portion of the box. Many other uses for a multiple compartment box can be imagined.

Figure 11:
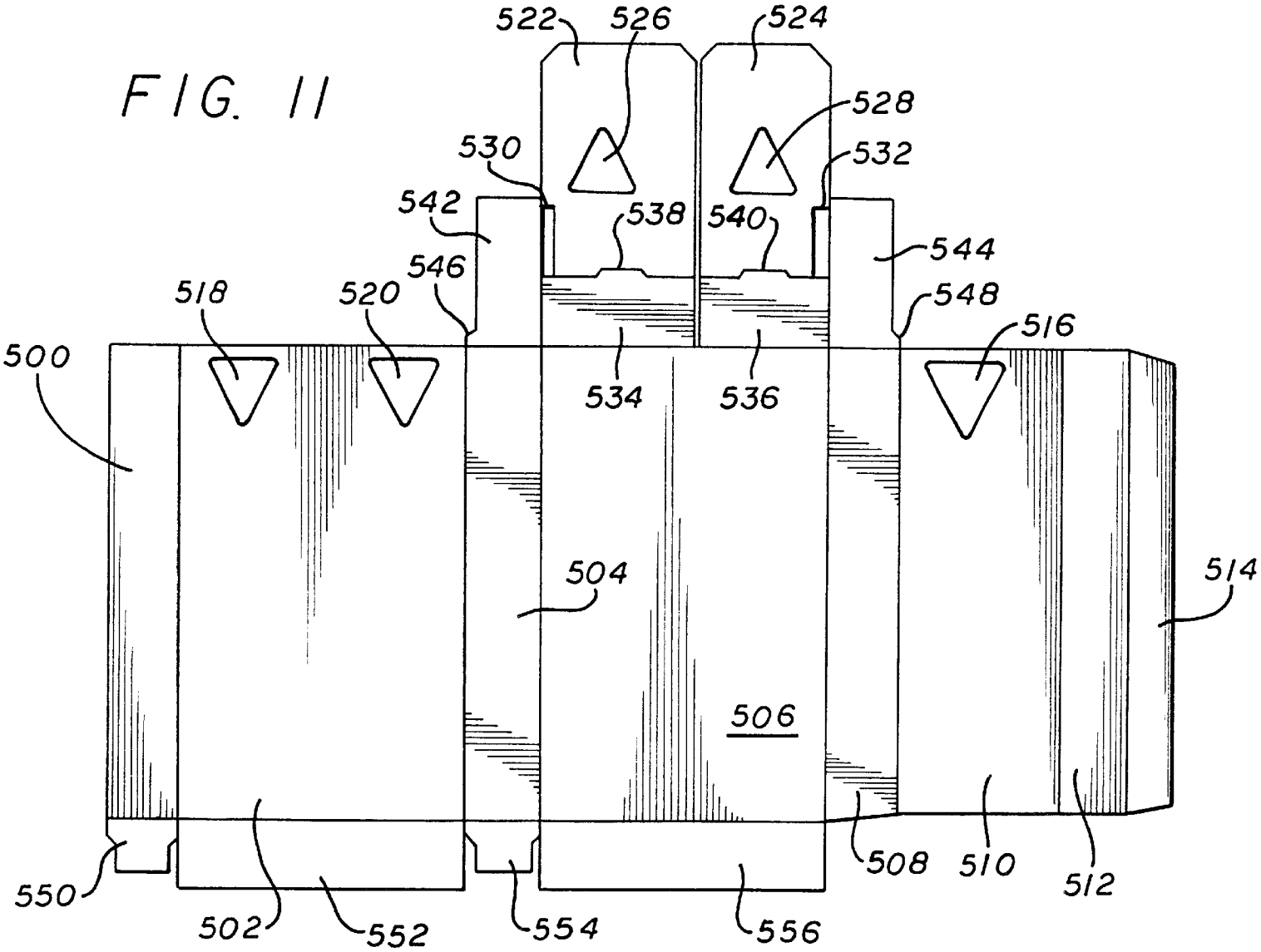
FIG. 11 illustrates a box blank that can be folded and secured to form a multiple compartment box.

FIG. 11 illustrates a box blank for forming a multiple compartment box. The box blank may be formed by die cutting a sheet of cardstock. The box blank may be cut with other methods known in the box cutting art, such as by laser cutting or other types of cutting.

The box blank of FIG. 11 has a side wall 500, a front wall 502, a side wall 504, a back wall 506, an inner side wall 508, a front compartment wall 510, an interior center wall 512, and a compartment retaining flap 514. The front compartment wall 510has an opening 516, which may be any shape. The front wall 502 includes openings 518 and 520. The box blank also includes a first slide 522 and a second slide 524. The slides include slide openings 526 and 528, respectively. The slides may also include notches 530 and 532, respectively, which may be part of an arrangement to retain the slides within the box after the box is constructed, as will be explained below.

Connected to the respective slides 522 and 524 are top flaps 534 and 536, respectively. Respective thumb flaps 538 and 540 are cut in between the respective top flaps and slides. Top inner flaps 542 and 544 are also provided, and are positioned beneath top flaps 536 and 538, respectively, when the blank is folded into a box. The inner flaps 542 and 544 are provided with notches 546 and 548, respectively, which work together with slide notches 530 and 532 to retain the slides 522 and 524 within the box when the blank is folded into a box.

The box blank of FIG. 11 is also provided with a bottom side flap 550, a bottom flap 552, and a bottom flap 556, which together form the bottom of the box when the box blank is folded into a box.

FIG. 12 illustrates the box blank of FIG. 11 as it appears when it is partially folded to form one compartment 510. The compartment retaining flap 514 is glued or otherwise secured to the back wall 506. The box blank may be pre-scored along fold lines to ensure accurate and convenient folding. Techniques for pre-scoring box blanks are well known in the art. The box is typically folded by automated machinery, but may also be folded by hand, if desired.

Figure 13:
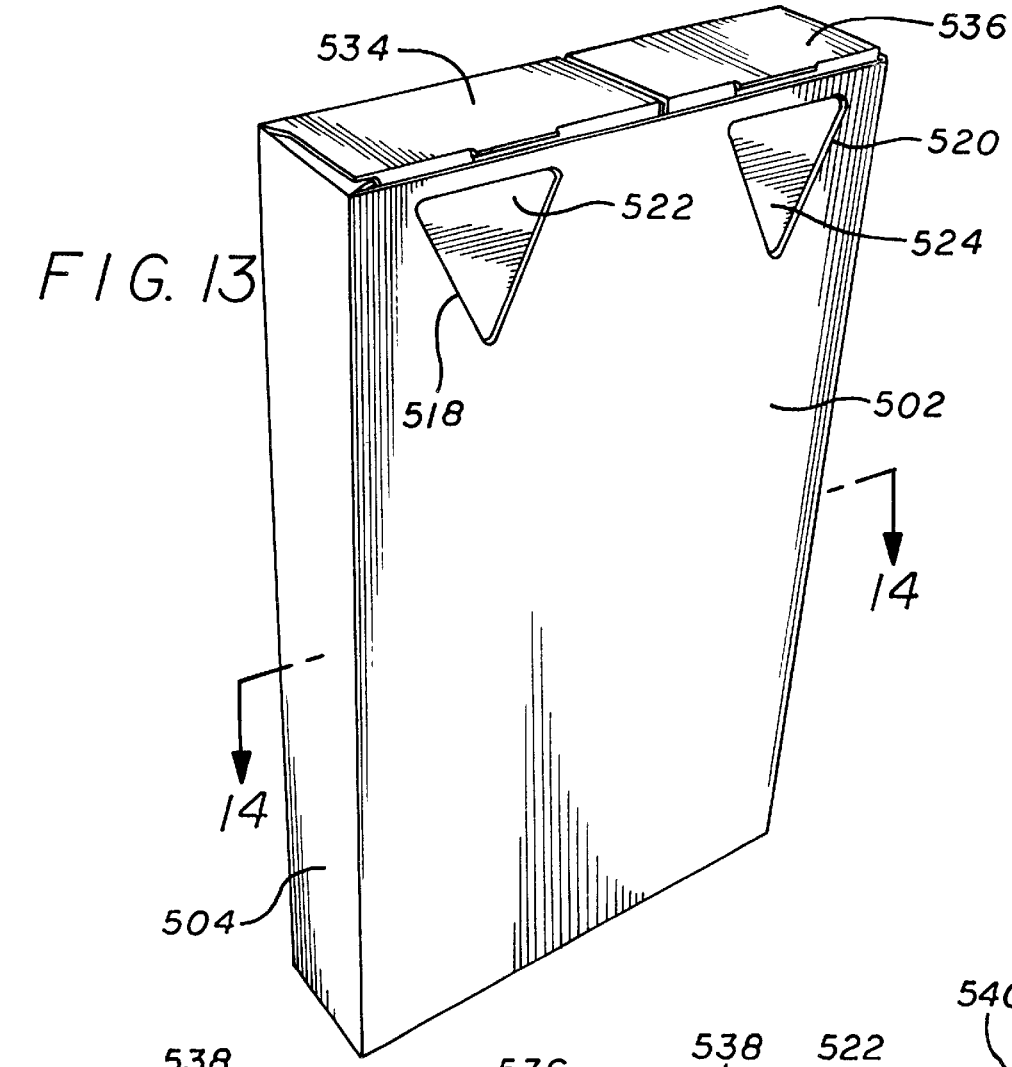
FIG. 13 illustrates a box formed from the box blank of FIG. 11.

FIG. 13 is a perspective view of a fully constructed box formed from the box blank of FIG. 11. The box has a fully closed position as in FIG. 13, in which the slide openings 526 and 528 are not in alignment with the openings 518 and 520 on the front of the box. Consequently, the box is closed, and the contents of the box cannot be poured out of the box.

FIG. 14 illustrates the interior of the box, as taken along Section 14—14 of FIG. 13. The box has two compartments, 560 and 562, in which two separate types of pourable items may be stored without intermingling. The interior center wall 512 separates the two compartments. The side wall 500 is secured to the side inner wall 508 with a standard box-forming glue that is known in the art, or by other known means.

Figure 15:
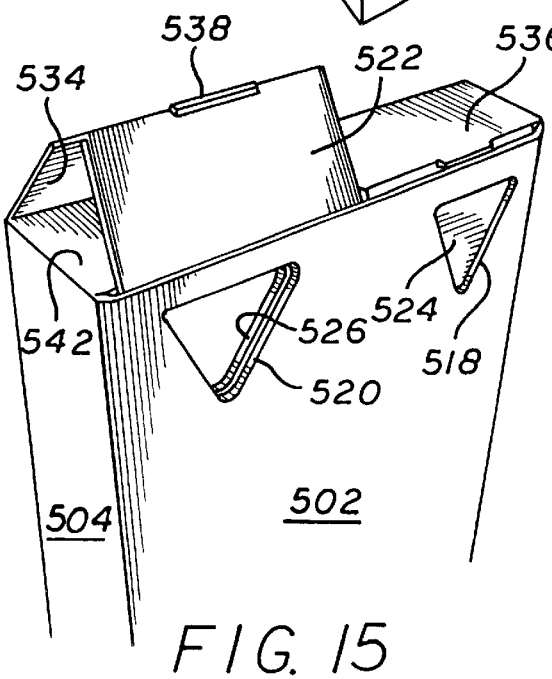
FIG. 15 illustrates the box of FIG. 13 with one slide in an open position.
Figure 16:
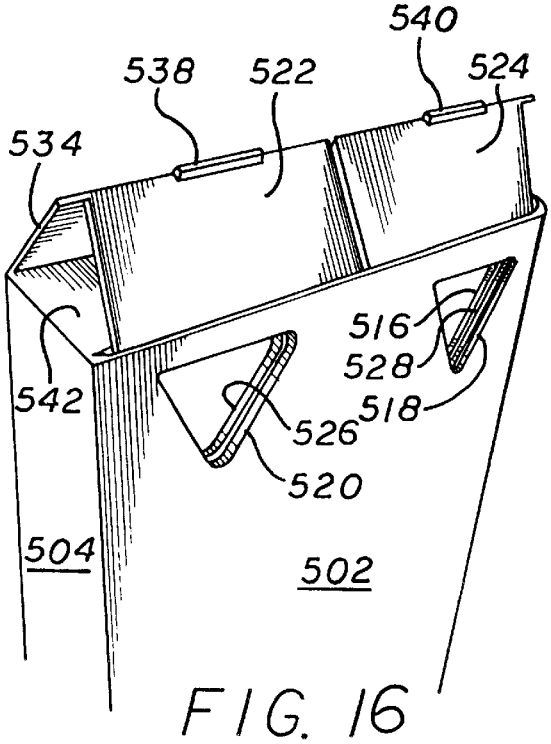
FIG. 16 illustrates the box of FIG. 13 with both slides in an open position.

FIG. 15 illustrates the box of FIG. 13 as it appears with one compartment open. In particular, the slide 522 has been raised such that the opening 518 is aligned with the opening 526 to open the compartment 562 (FIG. 14). In the configuration of FIG. 15, the contents of the compartment 562 can be poured from the box. FIG. 16 shows that the slide 524 may also be raised to open the second compartment 560, such that the opening 528 on the slide 524 is aligned with the opening 516 on the front compartment wall 510 and the opening 518 on the front wall 502. Consequently, the user may open and close the slides 522 and 524 in whatever combination is desired.

It should be noted that top inner flap 542 and the top inner flap 544, which may also be known as "minor" flaps, are typically glued or otherwise secured together when the box is formed to create a continuous inner flap. As an alternative to having two separate top inner flaps 542 and 544, a single longer flap may be used. So, for example the box can be designed with a single top inner flap similar to flap 542 but slightly more than twice as long, and without top inner flap 544.

FIGS. 17–19 illustrate an alternative multiple-compartment box design that is particularly adapted to minimize the use of material needed to construct the box. Referring to FIG. 17, an alternative box blank for forming a multiple-compartment package includes a side wall 600, a front wall 602, a side wall 604, a back wall 606 and a side wall 608. The blank also includes a top wall 610, a divider wall 612 and a retaining flap 614.

The front wall 602 includes openings 618 and 620. Slides 622 and 624 include openings 626 and 628, respectively. The slides 622 and 624 also include notches 630 and 632, respectively, which help to retain the slides within the box once the box is constructed. Top flaps 634 and 636 each include a respective thumb flap 638 or 640, which are die cut or cut by other means known in the art.

The box blank also includes a top flap 642 with a notch 646 that interacts with the notch 630 on slide 622 to retain the slide 622 within the box when the box is constructed. The box blank also includes bottom flaps 652, 654, 656 and 658, which can be glued together or otherwise secured when the box is constructed.

FIG. 18 illustrates the box blank of FIG. 17 partially constructed into a box. The box includes a compartment 660 that is defined by the dividing wall 612 on one side and the side wall 608 on the other. A second compartment is defined in between the dividing wall 612 and the side wall 604, in a manner similar to how the compartment 562 is formed in the embodiment of FIG. 14.

FIG. 19 illustrates that, as in the embodiment of FIGS. 13–16, the slides 622 and 624 can be selectively raised and lowered to open and close the compartments, as desired.

The multiple compartment embodiments of FIGS. 11–19 may be used in conjunction with inner liners. For example, a two-compartment embodiment may have one inner liner as shown in FIG. 10 for each compartment. The removable opening of each bag is lined up with a corresponding opening in the front wall of the box. To open the inner liner, the user opens the box and removes the removable member that is adjacent to the opening.

In another embodiment, the box is a single-compartment design having two or more slides. A single inner liner having two removable portions, each aligned with a corresponding slide opening when the slide is in the open position, may be used. Alternatively, two or more inner liners may be used so as to separate different pourable materials within the box. For example, in a single-compartment, two-slide design, two separate bags may be used. Each bag may have a removable portion aligned with a corresponding slide opening when the slide is in the open position.

As an alternative to having multiple openings in the front wall to correspond with openings in the multiple slides, the front wall may have a single elongated opening that is sufficiently large in dimension to provide an opening corresponding to the slide openings. The design of FIG. 17, for example, may be varied in order to form a box having additional compartments. For instance, the top flap 642 may be altered to be similar to the top wall 610, the divider wall 612 and the retaining wall 614. Then, a third compartment on the left hand side of the box can be formed. By adding one additional slide, a three compartment box can be constructed. Other multiple compartment boxes can be constructed by varying the design of the box blank.

In a box having more than one slide, one or more of the slides may have multiple openings. For instance, a slide may have a large opening to create a wide open position, and a smaller open to create a normal open position, depending on how wide an opening the user wants at a particular time. Alternatively, when the box is used in conjunction with an interior bag, a slide may have multiple openings to correspond to multiple openings in the bag. As a further alternative, whether used in conjunction with a bag or not, a slide may have multiple openings to correspond with multiple openings in the front wall of the box. Numerous other variations are possible within the scope of the invention.

It should be noted that the relative dimensions of the drawings are approximate. The drawings are intended to convey general concepts and are not precise engineering drawings. The particular dimensions of the various embodiments may be adjusted as necessary. For example, but not limitation, the openings 210 and 315 in FIGS. 4 and 5, respectively, may be made proportionately larger or smaller in particular embodiments of the box, as can the various other openings in the boxes and bags. The shapes of the openings may be varied, as well, and the openings in the slides need not precisely match the size or shape of the corresponding openings in the front wall of the box.

Similarly, what is referred to as the "front" and "side" of the box are interchangeable, in that the "front" may be narrower than the side, or vice versa.

Accordingly, the present invention is not limited precisely to the arrangements as shown in the drawings and as described in detail hereinabove.

What is claimed is:

1. A box for conveniently storing and dispensing food comprising:

a front wall having a first and a second opening and an inside surface;

a back wall;

a first and a second side wall;

a bottom flap and a first and a second top flap;

a first slide and a second slide that are in contact with the inside surface of the front wall, each of said slides having an opening;

wherein said front wall, said back wall, said first and second side walls, and said top and bottom flaps are interconnected so as to form a box, said first slide being movable between an open position in which said first slide opening substantially aligns with said first front wall opening and a closed position in which said first slide opening is entirely out of alignment with said first front wall opening;

said second slide being independently movable from said first slide, said first slide being movable between an open position in which said second slide opening substantially aligns with said second front wall opening and a closed position in which said second slide opening is entirely out of alignment with said second front wall opening; and at least one bag inside said box comprising at least one removable area, said removable area being positioned adjacent to at least one of said front wall openings.

2. A box as defined in claim 1, wherein said removable portion is defined by at least one line of weakness on said bag.

3. A box as defined in claim 1, wherein said removable portion is removably attached to said bag with a pressure sensitive adhesive.

4. A box for conveniently storing and dispensing food comprising:

a front wall having a first and a second opening and an inside surface;

a back wall;

a first and a second side wall;

a bottom flap and a first and a second top flap;

a first slide and a second slide that are in contact with the inside surface of the front wall, each of said slides having an opening;

wherein said front wall, said back wall, said first and second side walls, and said top and bottom flaps are interconnected so as to form a box, said first slide being movable between an open position in which said first slide opening substantially aligns with said first front wall opening and a closed position in which said first slide opening is entirely out of alignment with said first front wall opening;

said second slide being independently movable from said first slide, said first slide being movable between an open position in which said second slide opening substantially aligns with said second front wall opening and a closed position in which said second slide opening is entirely out of alignment with said second front wall opening;

said box further comprising an interior, said interior having a first compartment and a second compartment, said first compartment being opened when said first slide is in the open position, said second compartment being opened when said second slide is in the open position, an interior wall separating said first compartment from said second compartment;

said box further having a top opening and a top inner flap that extends across said top opening;

wherein said box has a first stop for defining the position of said first slide in the open position of said first slide and a second stop for defining the position of said second slide in the open position of said second slide; and the shapes of the openings in said slides being different than the shapes of the openings in said front wall.

5. A box for conveniently storing and dispensing products comprising:

a front wall having an inside surface;

a back wall;

a first and a second side wall, each having inside surfaces;

said front wall, said back wall, said first and second side walls, and said top and bottom flaps being interconnected so as to form a box;

at least one interior wall dividing said box into at least first and second compartments;

said first and second compartments having respective first and second wall openings;

a first slide and a second slide that are in contact with the inside surfaces of walls of said first and second compartments, respectively, each of said slides having an opening;

said first slide being movable between an open position in which said first slide opening substantially aligns with said first wall opening and a closed position in which said first slide opening is entirely out of alignment with said first wall opening;

said second slide being movable independently from said first slide, said second slide being movable between an open position in which said second slide opening substantially aligns with said second wall opening and a closed position in which said second slide opening is entirely out of alignment with said second front wall opening; and at least one of said compartments having at least three walls which are substantially formed of only a single thickness of the sheet material from which said box is formed.

6. A box as defined in claim 5 wherein said interior wall is formed from an elongated strip integrally secured to the top of the box and is folded and adhesively secured in place to separate the compartments.

7. A box as defined in claim 5 wherein said interior wall is formed from a folded flap secured to one of said side walls, which is further folded to extend within said front wall and then back to said rear wall where said folded flap terminates in close proximity to the junction of said folded flap and said rear wall where a strip of said folded flap is secured to said rear wall.

8. A box as defined in claim 5 wherein at least one of said slides is held against the inside surface of said front wall by overlapping said interior wall.

9. A box as defined in claim 5 wherein each of said slides has a cut away portion forming a stop by engagement with other portions of said box operative when said slide opening is aligned with said wall opening.

10. A box assembly as defined in claim 5 further comprising at lest one flexible bag mounted within at least one of said compartments.

11. A box assembly as defined in claim 5 wherein said top flap or flaps extend across the top of the box to keep the top of the box closed when either or both of said slides are in the open position.

12. A box as defined in claim 5 wherein said three walls are a front wall, a side wall and said interior wall.

13. A box as defined in claim 5 wherein all four walls of one of said compartments are formed substantially of a single layer of material from which said box is formed, and another of said compartments has at least two walls which are substantially formed of only a single thickness of material from which said box is formed.

14. A box for conveniently storing and dispensing products comprising:

a front wall having an inside surface;

a back wall;

a first and a second side wall, each having inside surfaces;

said front wall, said back wall, said first and second side walls, and said top and bottom flaps being interconnected so as to form a reclosable box;

at least one interior wall dividing said box into at least first and second compartments;

said first and second compartments having respective first and second wall openings;

a first slide and a second slide that are in contact with the inside surfaces of walls of said first and second compartments, respectively, each of said slides having an opening;

said first slide being movable between an open position in which said first slide opening substantially aligns with said first wall opening and a closed position in which said first slide opening is entirely out of alignment with said first wall opening;

said second slide being movable independently from said first slide, said second slide being movable between an open position in which said second slide opening substantially aligns with said second wall opening and a closed position in which said second slide opening is entirely out of alignment with said second front wall opening; and said interior wall being formed from an elongated strip integrally secured to the top of the box and being folded and adhesively secured in place to separate the compartments.

15. A box for conveniently storing and dispensing products comprising:

a front wall having an inside surface;

a back wall;

a first and a second side wall, each having inside surfaces;

said front wall, said back wall, said first and second side walls, and said top and bottom flaps being interconnected so as to form a box;

at least one interior wall dividing said box into at least first and second compartments;

said first and second compartments having respective first and second wall openings;

a first slide and a second slide that are in contact with the inside surfaces of walls of said first and second compartments, respectively, each of said slides having an opening;

said first slide being movable between an open position in which said first slide opening substantially aligns with said first wall opening and a closed position in which said first slide opening is entirely out of alignment with said first wall opening;

said second slide being movable independently from said first slide, said second slide being movable between an open position in which said second slide opening substantially aligns with said second wall opening and a closed position in which said second slide opening is entirely out of alignment with said second front wall opening; and said interior wall being formed from a folded flap secured to one of said side walls, which is further folded to extend within said front wall and then back to said rear wall where said folded flap terminates in close proximity to the junction of said folded flap and said rear wall where a strip of said folded flap is secured to said rear wall.

16. A box for conveniently storing and dispensing products comprising:

a front wall having an inside surface;

a back wall;

a first and a second side wall, each having inside surfaces;

said front wall, said back wall, said first and second side walls, and said top and bottom flaps being interconnected so as to form a box;

at least one interior wall dividing said box into at least first and second compartments;

said first and second compartments having respective first and second wall openings;

a first slide and a second slide that are in contact with the inside surfaces of walls of said first and second compartments, respectively, each of said slides having an opening;

said first slide being movable between an open position in which said first slide opening substantially aligns with said first wall opening and a closed position in which said first slide opening is entirely out of alignment with said first wall opening;

said second slide being movable independently from said first slide, said second slide being movable between an open position in which said second slide opening substantially aligns with said second wall opening and a closed position in which said second slide opening is entirely out of alignment with said second front wall opening; and wherein at least one of said slides is held against the inside surface of said front wall by overlapping said interior wall.

17. A box for conveniently storing and dispensing products comprising:

a front wall having an inside surface;

a back wall;

a first and a second side wall, each having inside surfaces;

said front wall, said back wall, said first and second side walls, and said top and bottom flaps being interconnected so as to form a box;

at least one interior wall dividing said box into at least first and second compartments;

said first and second compartments having respective first and second wall openings;

a first slide and a second slide that are in contact with the inside surfaces of walls of said first and second compartments, respectively, each of said slides having an opening;

said first slide being movable between an open position in which said first slide opening substantially aligns with said first wall opening and a closed position in which said first slide opening is entirely out of alignment with said first wall opening;

said second slide being movable independently from said first slide, said second slide being movable between an open position in which said second slide opening substantially aligns with said second wall opening and a closed position in which said second slide opening is entirely out of alignment with said second front wall opening; and each of said slides having a cut away portion forming a stop by engagement with other portions of said box operative when said slide opening is aligned with said wall opening.

18. A box for conveniently storing and dispensing products comprising:

a front wall having an inside surface;

a back wall;

a first and a second side wall, each having inside surfaces;

said front wall, said back wall, said first and second side walls, and said top and bottom flaps being interconnected so as to form a box;

at least one interior wall dividing said box into at least first and second compartments;

said first and second compartments having respective first and second wall openings;

a first slide and a second slide that are in contact with the inside surfaces of walls of said first and second compartments, respectively, each of said slides having an opening;

said first slide being movable between an open position in which said first slide opening substantially aligns with said first wall opening and a closed position in which said first slide opening is entirely out of alignment with said first wall opening;

said second slide being movable independently from said first slide, said second slide being movable between an open position in which said second slide opening substantially aligns with said second wall opening and a closed position in which said second slide opening is entirely out of alignment with said second front wall opening; and at least one flexible bag mounted within at least one of said compartments.

* * * * *